United States Patent [19]

Karol

[11] Patent Number: 4,935,157

[45] Date of Patent: Jun. 19, 1990

[54] 2-HYDROXY-1,3,4-THIADIAZOLES AND LUBRICATING COMPOSITIONS CONTAINING SAME

[75] Inventor: Thomas J. Karol, Norwalk, Conn.

[73] Assignee: R. T. Vanderbilt Company, Inc., Norwalk, Conn.

[21] Appl. No.: 361,182

[22] Filed: Jun. 5, 1989

[51] Int. Cl.[5] ..... C10M 1/38

[52] U.S. Cl. ..... 252/47.5; 252/47; 252/46.4; 548/142

[58] Field of Search ..... 252/47.5, 46.4, 47; 548/142

[56] References Cited

U.S. PATENT DOCUMENTS

| | | | |
|---|---|---|---|
| 2,764,547 | 9/1956 | Fields | 252/32.7 |
| 3,663,561 | 5/1972 | Blaha | 260/302.5 D |
| 4,301,019 | 11/1981 | Horodysky | 252/47.5 |
| 4,761,482 | 8/1988 | Karol | 548/142 |

FOREIGN PATENT DOCUMENTS

| | | | |
|---|---|---|---|
| B28560 | 10/1955 | Fed. Rep. of Germany | 252/47.5 |

*Primary Examiner*—William R. Dixon, Jr.
*Assistant Examiner*—Miriam Sohn
*Attorney, Agent, or Firm*—Rasma B. Balodis

[57] ABSTRACT

This invention concerns novel 2-hydroxy-5-alkylthio-1,3,4-thiadiazoles wherein the alkyl group may be substituted by hydroxy and phenoxy groups. The compounds are effective antiwear agents and antioxidants when incorporated into lubricating compositions.

7 Claims, No Drawings

2-HYDROXY-1,3,4-THIADIAZOLES AND LUBRICATING COMPOSITIONS CONTAINING SAME

BACKGROUND OF THE INVENTION

The present invention concerns novel derivatives of thiadiazole compounds. More particularly, novel 1,3,4-thiadiazoles are substituted by a hydroxy group on the thiadiazole ring. The invention further concerns improved lubricating compositions containing said compounds.

Additives known as antiwear agents are employed to increase the load-carrying capacity of lubricants. The antiwear agents promote the formation of a surface film and thereby prevent wear of the contacting surfaces.

During the course of use, lubricants are susceptible to deterioration due to oxidation. The oxidative process leads to the loss of lubricating properties and inadequate protection of the device to be lubricated. Antioxidants are added to inhibit the oxidative process. Thus, it is desirable that antiwear agents possess antioxidant properties.

Prior art has disclosed certain thiadiazole type compounds and their use as lubricating additives. However, due to stricter environmental controls, there is a need for new and more effective ashless-type additives preferably possessing multifunctional properties.

SUMMARY OF THE INVENTION

In accordance with the invention, there are provided novel 1,3,4-thiadiazole compounds characterized by the structural formula

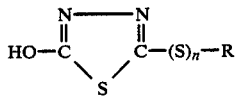

(I)

wherein R represents alkyl group which may have a hydroxy or phenoxy substituent group and terpene residue and n=1-2.

Another aspect of the invention concerns improved oil-based lubricating compositions comprising a major amount of base oil and an amount sufficient to impart antiwear and antioxidant characteristics to said composition, of a 1,3,4-thiadiazole characterized by formula I.

A further aspect of the invention concerns improved water-based lubricating compositions comprising at least 40 percent by weight of water, from 0 to 15 percent by weight of a petroleum hydrocarbon oil or a synthetic oil and from about 0.1 to 10 percent by weight of a compound having the structural formula I.

DESCRIPTION OF SPECIFIC EMBODIMENTS

The novel compounds of the invention may be prepared by hydroxide induced displacement of an intramolecular functional group according to the following reaction scheme.

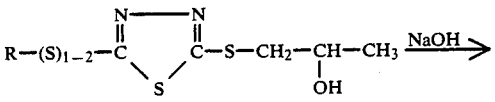

-continued

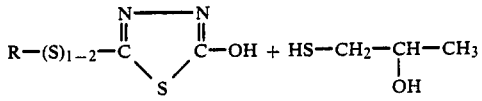

Preferably, the reaction is conducted in the presence of an inert solvent such as alcohols, toluene and acetone. The reaction temperature will depend upon the specific reactants and solvent media employed. Typically, reaction temperatures range from about 20° C. to 140° C. The reaction illustrated by the equation is the preferred method. Other methods of synthesis may be used.

The group R in the formula I represents an alkyl group having from 2 to 49 carbon atoms. The alkyl group may be a straight, branched or cyclic chain including alkyls substuted by hydroxy and phenoxy groups. These include, among others, ethyl, n-propyl, iso-propyl, n-butyl, iso-butyl, sec-butyl, pentyl, octyl, dodecyl, octadecyl, cyclohexyl, cycloheptyl, 2-methylcycloheptyl and 3-butylcyclohexyl group. The alkyl group may be derived from a polyolefin starting material. The polymer may contain an epoxide or chlorine functionality at one end and the polymeric chain may contain up to 49 carbon atoms. The polymers may contain straight chain and branched chain alkyl units. Especially useful are polymers of alpha-olefins as for example isopropene, isobutene, 2-methyl-1-heptene and 2-methyl-5-propylhexene. The cyclic groups may be derived from terpene residues as for example pinene and limonene.

The thiadiazole derivatives of the invention are useful as lubricating additives. The compounds possess multifunctional properties. In addition to being capable of acting as antioxidants, they also perform antiwear functions.

The lubricating compositions contemplated herein include lubricating oils and lubricating greases containing a major amount of base oil. The base oil may be selected from oils derived from petroleum hydrocarbon and synthetic sources. The hydrocarbon base oil may be selected from naphthenic, aromatic, and paraffinic mineral oils. The synthetic oils may be selected from, among others, alkylene polymers, polysiloxanes, carboxylic acid esters and polyglycol ethers.

Another lubricating composition useful herein includes water based systems. Typically, the aqueous systems comprise at least 40 percent of water and zero to less than 15 percent of base oil. The additives are incorporated in the system with the aid of solubilizer/stabilizer systems. The water based systems are useful not only as lubricants, but also as functional fluids such as cutting oils, hydraulic fluids, and transmission fluids.

The amount of the thiadiazole additive required to be effective for imparting antiwear and antioxidant characteristics in lubricating compositions may range from about 0.01 to 10 percent of the lubricating composition. The preferred range is about 0.1 to 5.0 percent of the additive of the total lubricating composition.

The lubricating compositions may contain the necessary ingredients to prepare the composition as for example emulsifiers and viscosity improvers. Greases may be prepared by adding thickeners as for example salts and complexes of fatty acids, polyurea compounds, clays and quaternary ammonium bentonite. Depending on the intended use of the lubricant, other functional additives may be added to enhance a particular property of the lubricant. The lubricating compositions may further contain extreme pressure agents, metal passivators, rust inhibitors, dispersants and other known antioxidants and antiwear agents.

The following examples are given for the purpose of further illustrating the invention. All percentages and parts are based on weight unless otherwise indicated.

EXAMPLE 1

Preparation of 2-hydroxy-5-(2-hydroxypropylthio)-1,3,4-thiadiazole.

2,5-Dimercapto-1,3,4-thiadiazole (DMTD) (276.21 g, 1.84 mol) and isopropanol (400 ml) were charged to a reaction flask fitted with a reflux condenser. Propylene oxide (22.8 g, 3.84 mol) was added, with stirring, at a rate to maintain reflux. The reaction was stirred for 15 min. and then solvent was stripped under reduced pressure by rotary evaporation. This intermediate product (157.5 g, 0.592 mol), water (100 ml) and sodium hydroxide (23.7 g) were charged to a reaction flask and stirred until homogenous. Unreacted material was extracted with ether (200 ml) and additional water (200 ml). The water layer was acidified and extracted with diethyl ether (200 ml). The ether layer was separated and washed with water (200 ml). The acidified ether extract was dried over magnesium sulfate and filtered. The solvent was removed by rotary evaporation under reduced pressure. A yield of 99.2 g. was obtained.

EXAMPLE 2

Preparation of 2-hydroxy-5-{2-hydroxypolyisobutylthio (C 22)}-1,3,4-thiadiazole.

DMTD (25 g, 0.167 mol) and epoxidized polyisobutylene (mol. wt. 365, 80 g) in isopropanol (200 ml) were charged to a reaction flask. The reaction was stirred at room temperature for 3 hours. Propylene oxide (12 g, 0.2 mol) was added and the reaction was refluxed for 10 minutes. Propylene oxide was removed under reduced pressure. Sodium hydroxide (14 g) in water (50 ml) was added to the reaction and stirred for 1 hour. Unreacted polyisobutylene was extracted with hexane (200 ml). The pH of the water layer was adjusted to about two with sulfuric acid and extracted with hexane. The hexane layer was dried over magnesium sulfate and stripped of solvent by rotary evaporation under reduced pressure. The yield was 41.45 g.

EXAMPLE 3

Preparation of 2-hydroxy-5-pinanylthio-1,3,4-thiadiazole.

Alpha-pinene (49 g, 0.35 mol), DMTD (50 g, 0.33 mol) and isopropanol (40 ml) were charged to a reaction flask and heated to reflux. Isopropanol was allowed to distill until the reaction temperature reached 105° to 110° C. The reaction is exothermic and may reflux vigorously as temperature climbs, if not controlled. After cooling below 100° C., propylene oxide (21 g, 0.36 mol) was added with equal volume of isopropanol. The reaction was refluxed for 15 min. and stripped of solvent by rotary evaporation under reduced pressure. Ammonium hydroxide (21 ml) and toluene (150 ml) were added. After 15 min. stirring, the toluene layer was stripped of to afford the product.

EXAMPLE 4

Preparation of 2-ethylthio-5-hydroxy-1,3,4-thiadiazole.

DMTD (50 g, 0.33 mole), isopropanol (200 ml) and sodium hydroxide (13.3 g, 0.33 mole) were charged to a reaction flask. Ethyl bromide (36.3 g, 0.33 mol) was added at reflux temperature and refluxed for 1 hour. The precipitated reaction product was extracted with water (500 ml) and diethyl ether (300 ml). The ether layer was washed with 1M NaOH (400 ml), dried over magnesium sulfate and stripped of solvent to afford the bisethyl adduct (7.68 g). The basic aqueous layer was acidified and extracted with ether (300 ml) to afford the intermediate monoethyl adduct, 2-ethylthio-5-mercapto-1,3,4-thiadiazole (1.34 g, 7.52 mmol), methylene chloride (10 ml), acetone (1 ml) and propylene oxide (1.3 g, 22 mmol) were charged in a reaction flask and refluxed for one minute. After stripping of solvent, ammonium hydroxide (5 ml) was added. The reaction was extracted with diethyl ether and water. The aqueous layer was acidified and extracted with diethyl ether. The ether layer was dried over magnesium sulfate, filtered and stripped of solvent to afford the product.

EXAMPLE 5

Preparation of 2-(tert-dodecyldithio)-5-hydroxy-1,3,4-thiadiazole.

2-(tert-Dodecyldithio)-5-mercapto-1,3,4-thiadiazole (92 g, 0.263 mol), isopropanol (90 g) and propylene oxide (20 g, 0.34 mol) were charged to a reaction flask. The reaction was stirred and refluxed for 2 hours. The solvent and excess propylene oxide were removed by rotary evaporation under reduced pressure. The propylene oxide intermediate was mixed with water (300 ml), acetone (100 ml), and sodium hydroxide (12 g). After 10 minutes, the pH was adjusted to about 2 with sulfuric acid. The product was extracted with toluene (200 ml). The extract was dried over magnesium sulfate, filtered and the solvent stripped off by rotary evaporation under reduced pressure to afford the product.

EXAMPLE 6

Shell Four-Ball Wear Test

The test was conducted essentially according to the method described in ASTM D-2266 procedure. Four highly polished steel balls 12.5 mm in diameter were placed in a test cup and submerged in the test sample. The test oil was Sunvis TM 21 manufactured by Sun Oil Company. The test was carried out at a rotation speed of 1800 rpm under a load of 40 kg at 93° C. for 60 minutes. The diameter of wear scar produced by samples containing no additive and containing additive of the invention was measured and the data compiled in Table I. The data indicate that the additive of the invention has good antiwear properties even when present at the relatively low quantity of 0.05 percent.

TABLE I

| Four-Ball Wear Test | | | |
|---|---|---|---|
| Sample | Active Ingredient | Percent | Scar Diameter, mm |
| 1 | None | — | 1.8–2.0 |
| 2 | 2-Hydroxy-5-(2-hydroxy-polyisobutylthio-1,3,4-thiadiazole | 0.05 | 0.6–0.8 |

The test was conducted essentially according to the method described by Chia-Soon Ku et al, *J. Am. Soc.*

*Lubricating Eng.*, 40, 2 75–83, 1984. The oxidation induction time of the lubricant was measured under conditions which simulate the high temperature oxidation processes in automotive engines by a modified rotary bomb oxidation test method ASTM D-2272. The test was conducted with 1.5 gram samples of Sunvis 21 oil. A compound of the invention was added to the oil in the amount indicated in Table II. The test was conducted at 160° C. and initial oxygen pressure of 620.6 kPa (90 psi). A "pass" oil has a high induction time, while a "fail" oil has a low time. The additive of the invention has good antioxidant properties as indicated by the data compiled in Table II.

TABLE II

Thin Film Oxygen Uptake Test

| Sample | Additive | Percent | Average Induction Time, Min. |
|---|---|---|---|
| 3 | None | — | 90.0 |
| 4 | 2-Hydroxy-5-(2-hydroxy-polyisobutyl)-1,3,4-thiadiazole | 0.35 | 145.0 |
| 5 | 2-(tert-Dodecyldithio)-5-hydroxy-1,3,4-thiadiazole | 0.35 | 145.0 |

The above embodiments have shown various aspects of the present invention. Other variations will be evident to those skilled in the art and such modifications are intended to be within the scope of the invention as defined by the appended claims.

What is claimed is:

1. A novel compound having the structural formula

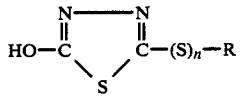

wherein R represents a terpene residue selected from the group consisting of pinene and limone or alkyl group which contains 2 to 49 carbon atoms and may be substituted by a hydroxy or phenoxy group and n = 1–2.

2. The compound according to claim 1 wherein the alkyl is straight chain, branched chain or cyclic.

3. The compound according to claim 1 which is 2-hydroxy-5-(2-hydroxypropylthio)-1,3,4-thiadiazole.

4. The compound according to claim 1 which is 2-hydroxy-5-(2-hydroxypolyisobutylthio)-1,3,4-thiadiazole.

5. The compound according to claim 1 which is 2-(tert-dodecyldithio)-5-hydroxy-1,3,4-thiadiazole.

6. A composition comprising a major amount of oil of lubricating viscosity wherein said oil is a petroleum hydrocarbon oil or a synthetic oil and from about 0.1 to 10 percent by weight of a compound having the structural formula

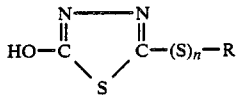

wherein R represents a terpene residue selected from the group consisting of pinene and limonene or alkyl group which contains 2 to 49 carbon atoms and may be substituted by a hydroxy or phenoxy group and n = 1–2.

7. A composition comprising at least 40 percent by weight of water, from 0 to 15 percent by weight of a petroleum hydrocarbon oil or a synthetic oil and from about 0.1 to 10 percent by weight of a compound having the structural formula

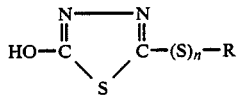

wherein R represents a terpene residue selected from the group consisting of pinene and limonene or alkyl group which contains 2 to 49 carbon atoms and may be substituted by a hydroxy or phenoxy group and n = 1–2.

* * * * *

UNITED STATES PATENT AND TRADEMARK OFFICE

CERTIFICATE OF CORRECTION

PATENT NO. : 4,935,157

DATED : June 19, 1990

INVENTOR(S) : Thomas J. Karol

It is certified that error appears in the above-identified patent and that said Letters Patent is hereby corrected as shown below:

Column 1, line 63 insert -- 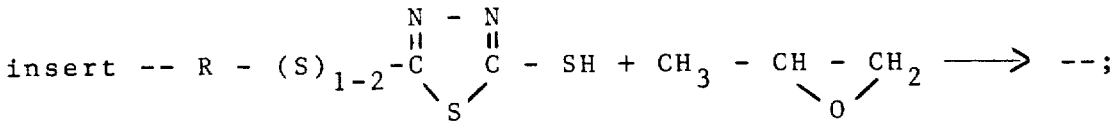 --;

Column 4, Table I, lines 63-65

"2-Hydroxy-5-(2-hydroxypolyisobutylthio-1,3,4-thiadiazole" should be -- 2-Hydroxy-5-(2-hydroxypolyisobutylthio)-1,3,4-thiadiazole --;

Column 5, Table II, lines 21-23

"2-Hydroxy-5-(2-hydroxypolyisobutyl)-1,3,4-thiadiazole" should be -- 2-Hydroxy-5-(2-hydroxypolyisobutylthio)-1,3,4-thiadiazole --.

Signed and Sealed this

Twenty-seventh Day of August, 1991

*Attest:*

HARRY F. MANBECK, JR.

*Attesting Officer*

*Commissioner of Patents and Trademarks*